US011781814B2

(12) United States Patent
Kasim

(10) Patent No.: US 11,781,814 B2
(45) Date of Patent: Oct. 10, 2023

(54) TAPERED GROOVE WIDTH HEAT PIPE

(71) Applicant: The Boeing Company, Chicago, IL (US)

(72) Inventor: Kawthar Kasim, Long Beach, CA (US)

(73) Assignee: The Boeing Company, Arlington, VA (US)

( * ) Notice: Subject to any disclaimer, the term of this patent is extended or adjusted under 35 U.S.C. 154(b) by 204 days.

(21) Appl. No.: 16/820,701

(22) Filed: Mar. 16, 2020

(65) Prior Publication Data

US 2021/0285729 A1 Sep. 16, 2021

(51) Int. Cl.
*F28D 15/02* (2006.01)
*F28D 15/04* (2006.01)

(52) U.S. Cl.
CPC ..... *F28D 15/0233* (2013.01); *F28D 15/04* (2013.01); *F28D 15/046* (2013.01)

(58) Field of Classification Search
CPC ..... F28D 15/0233; F28D 15/0241; F28D 15/0266; F28D 15/04; F28D 15/046
See application file for complete search history.

(56) References Cited

U.S. PATENT DOCUMENTS 3,468,020 A * 9/1969 Eller ..... H01R 43/08 264/274
3,537,514 A 11/1970 Levedahl et al.
3,746,081 A * 7/1973 Corman ..... F28D 15/046 165/272
4,087,893 A * 5/1978 Sata ..... B21C 23/007 29/890.032
4,168,618 A * 9/1979 Saier ..... B21C 37/207 165/184
4,425,942 A * 1/1984 Hage ..... F28F 1/40 72/276
4,765,396 A * 8/1988 Seidenberg ..... F28D 15/043 165/905
5,010,951 A * 4/1991 Kapolnek ..... C23F 1/04 29/890.032
5,527,588 A 6/1996 Camarda et al.
(Continued)

FOREIGN PATENT DOCUMENTS

EP 0417299 A1 * 3/1991 ..... F28D 15/02
FR 2850453 A1 * 7/2004 ..... B64G 1/506

OTHER PUBLICATIONS

Bruce Drolan, "Reflux Performance of Spacecraft Heat Pipes", 39th AIAA Aerospace Sciences Meeting & Exhibit, Jan. 8, 2001, 9 Pages, American Institute of Aeronautics and Astronautics, Inc., Reno, Nevada.

(Continued)

*Primary Examiner* — Travis Ruby
*Assistant Examiner* — Christopher C Pillow
(74) *Attorney, Agent, or Firm* — Kolisch Hartwell, P.C.

(57) ABSTRACT

A tapered groove width heat pipe is disclosed, including a tube having an internal surface, a first end, a second end, and a central axis. A plurality of groove walls on the internal surface define a plurality of trapezoidal grooves. Each groove wall has a proximal width closest to the central axis and a distal width furthest from the central axis, the proximal width of a portion of each groove wall tapering gradually between the first end and the second end.

20 Claims, 2 Drawing Sheets

(56) References Cited

U.S. PATENT DOCUMENTS

| | | | | |
|---|---|---|---|---|
| 5,725,050 | A | 3/1998 | Meyer, IV et al. | |
| 5,960,866 | A | 10/1999 | Kimura et al. | |
| 6,942,016 | B2 * | 9/2005 | Kobayashi | B64G 1/503 165/47 |
| 6,951,243 | B2 * | 10/2005 | Nilson | F28D 15/043 174/15.1 |
| 7,848,624 | B1 * | 12/2010 | Zimbeck | F28D 15/046 392/386 |
| 9,879,921 | B2 * | 1/2018 | Lee | F28F 1/32 |
| 2005/0081552 | A1 * | 4/2005 | Nilson | F28D 15/043 62/311 |
| 2006/0005960 | A1 * | 1/2006 | Hsu | F28D 15/046 165/260 |
| 2006/0011328 | A1 * | 1/2006 | Hui-Chun | F28D 15/046 165/104.26 |
| 2018/0187979 | A1 * | 7/2018 | Drolen | F28D 15/0266 |

OTHER PUBLICATIONS

R.C. Prager et al., "Spacecraft Thermal Control Handbook, vol. 1: Fundamental Technologies: Chapter 14 Heat Pipes", Dec. 15, 2002, 34 Pages, The Aerospace Press, El Segundo, California.

Li Xibing et al., "Study on Heat Transfer Performance of Micro Heat Pipe with Trapezium-Grooved Wick", 2010 International Conference on Optoelectronics and Image Processing, Dec. 2010, 5 Pages, Qiqihar University, Qiqihar, Heilongjiang, China, Qiqihar CNC Equipment Corp. Ltd., Qiqihar, Heilongjiang, China, and Harbin University of Science & Technology, Harbin, Heilongjiang, China.

K.R. Schlitt et al., "Parametric Performance of Extruded Axial Grooved Heat Pipes from 100° to 100° K", American Institute of Aeronautics and Astronautics, Aug. 23, 2012, retrieved Aug. 28, 2019, 20 pages, NASA Ames Research Center, Moffett field, California.

* cited by examiner

TAPERED GROOVE WIDTH HEAT PIPE

FEDERALLY SPONSORED RESEARCH OR DEVELOPMENT

The invention described herein was made with Government support in the performance of work under Defense Advanced Research Project Agency (DARPA) Contract No. DE-AR0000692. The government has certain rights in this invention.

BACKGROUND

Heat pipes are widely used and are often critical components in thermal control systems. Typically, heat pipes are designed to acquire a heat load at a hot interface and transfer the heat load at a cold interface. To effectively transfer the heat load, a working fluid is evaporated at the hot interface, a vapor thus formed travels along a vapor space to the cold interface, where it is condensed back to a liquid, and the liquid flows back to the hot interface through a wick structure under the influence of capillary forces. The capillary forces result from the difference between vapor and liquid pressures of the working fluid at the liquid-vapor interface of the wick structure. Pumping pressure of the heat pipe is therefore dependent on geometry of the wick structure and vapor space. Heat pipes designed for greater pumping pressure and improved overall performance are desirable, to meet the demand for efficient thermal control systems.

SUMMARY

The present disclosure provides systems, and apparatuses relating to a tapered groove width heat pipe. In some examples, a heat pipe may include a tube having an internal surface, a first end, a second end, and a central axis. A plurality of trapezoidal grooves in the internal surface, are defined by a plurality of groove walls. Each groove wall has a proximal width closest to the central axis and a distal width furthest from the central axis, the proximal width of a portion of each groove wall tapering gradually between the first end and the second end.

In some examples, a heat pipe may include a pipe having a vapor space, a first end and a second end, and a wick structure surrounding the vapor space and having a plurality of grooves. Each groove has an opening to the vapor space, a portion of each opening varying gradually in width between the first end and the second end.

In some examples, a heat pipe may include a vapor space, a first end, and a second end, and a wick structure surrounding the vapor space and having a plurality of grooves. A plurality of grooves are defined between a plurality of walls, each wall having a first width proximate the vapor space and a second width distal from the vapor space, the first width of a portion of each wall tapering gradually between the first end and the second end of the pipe.

Features, functions, and advantages may be achieved independently in various examples of the present disclosure, or may be combined in yet other examples, further details of which can be seen with reference to the following description and drawings.

DETAILED DESCRIPTION

Figure 1:
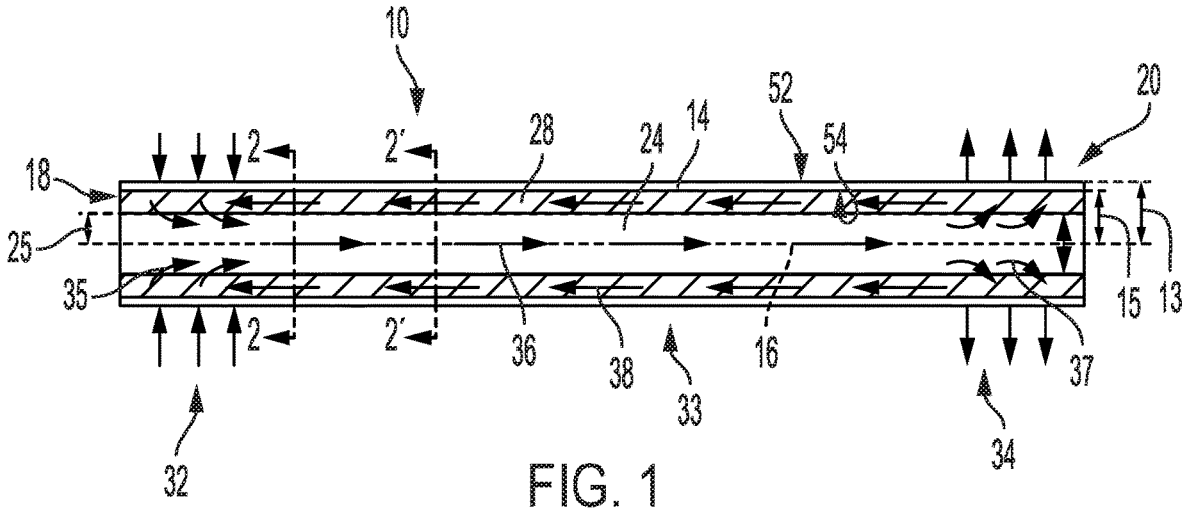
FIG. 1 is a schematic representation of an illustrative heat pipe in accordance with aspects of the present disclosure.

Various aspects and examples of a tapered groove width heat pipe are described below, and illustrated in the associated drawings. Unless otherwise specified, a heat pipe in accordance with the present teachings, and/or its various components may, but are not required to, contain at least one of the structures, components, functionalities, and/or variations described, illustrated, and/or incorporated herein. Furthermore, unless specifically excluded, structures, components, functionalities, and/or variations described, illustrated, and/or incorporated herein in connection with the present teachings may be included in other similar devices, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2) Examples, Components, and Alternatives; (3) Illustrative Combinations and Additional Examples; (4) Advantages, Features, and Benefits; and (5) Conclusion.

Overview

In general, a heat pipe in accordance with the present teachings may include a grooved wick structure surrounding a vapor space. Each groove of the wick structure may be open to the vapor space at a groove opening, from a first end of the heat pipe to a second end of the heat pipe. Widths of the groove openings may vary along the length of the heat pipe. More specifically, the width of each groove opening may taper gradually for some portion of the heat pipe, such that the groove opening width is greater at the second end of the heat pipe.

The grooves of the wick structure may have any shape, such as trapezoidal or teardrop, such that the flow area of the groove remains sufficient to keep liquid pressure drop low as the groove opening varies. Dimensions of the groove aside from the groove opening width such as depth and width distal from the vapor space may remain constant along the heat pipe. The heat pipe may be additively manufactured, to allow efficient, low-cost production of the variable groove opening width.

Examples, Components, and Alternatives

The following sections describe selected aspects of exemplary heat pipes as well as related systems and/or methods. The examples in these sections are intended for illustration and should not be interpreted as limiting the entire scope of the present disclosure. Each section may include one or more distinct examples, and/or contextual or related information, function, and/or structure.

Illustrative Heat Pipe

As shown in FIGS. 1-4, this section describes an illustrative heat pipe. Heat pipe 10 is an example of a tapered groove width heat pipe as described above. The heat pipe may be configured to be used independently or to be included in a conventional thermal control system.

As depicted in FIG. 1, heat pipe 10 includes an elongated, tubular pipe wall 14 with a central axis 16, and extends between a first end 18 and a second end 20. In the present example, the first and second ends are sealed by end caps (not shown), such that the heat pipe may act as an independent heat pipe. In other examples, the first and second ends may be left open, and the heat pipe may be configured to connect with other heat pipes and/or form a part of a larger thermal control system.

In the present example, pipe wall 14 is cylindrical, with a circular cross section. The pipe wall has an outer radius 13, an inner radius 15, and a uniform wall thickness. Pipe wall 14 has an outer surface 52 and an inner surface 54, which are each coaxial with central axis 16. In some examples the cross section or radii of the pipe wall may vary along the length of heat pipe 10.

In general, pipe wall 14 may have any appropriate geometry. The pipe wall may include linear, non-linear, and/or curvilinear pipe sections, and/or a plurality of twists and turns. In some examples, outer radius 13 at first end 18 may be greater than the outer radius at second end 20, to form a pipe structure which tapers from the first end to the second end. In some examples, outer radius 13 may increase from first end 18 to a central point and decrease back to second end 20, forming a convex structure.

Heat pipe 10 further includes a vapor space 24, defined by a wick structure 28 extending between the first and second ends of the pipe. Vapor space 24 is surrounded by wick structure 28, which is disposed within pipe wall 14, about a periphery of the pipe wall. Vapor space 24 and wick structure 28 are each concentric about central axis 16 and extend the length of the heat pipe from first end 18 to second end 20.

In the present example, vapor space 24 is also cylindrical and has a circular cross section with a constant radius 25. In some examples, radius 25 and/or the cross section of vapor space 24 vary along heat pipe 10. However, the cross-sectional area of vapor space 24 may affect the pumping power of heat pipe 10 as discussed further below, and therefore a constant cross section may be preferable.

It may be appreciated that a working fluid is necessary for operation of heat pipe 10. The working fluid may be chosen based at least in part on an operating temperature range and the material of pipe wall 14. The chosen working fluid may be able to exist as both a liquid 37 and a vapor 35 within the operating temperature range of the heat pipe. Appropriate working fluids may range from liquid helium for extremely low temperature applications (−271° C.) to silver (>2,000° C.) for extremely high temperatures. In the present example, the working fluid is ammonia. Other examples of working fluids include water, organic liquid, molten salt or molten metal.

First end 18 of heat pipe 10 includes an evaporator region 32. Second end 20 includes a condenser region 34. When the heat pipe 10 is in equilibrium with an isothermal environment, the liquid in the wick structure and the vapor in the vapor space may be in saturation. When evaporator region 32 acquires a heat load from a heat source, liquid in the wick structure may evaporate to form vapor 35, and simultaneously cool the heat source. The vapor may flow from the evaporator region, through the pipe along vapor flow direction 36, to the condenser region, and condense back into a liquid 37, and simultaneously release latent heat. Heat pipe 10 may have an adiabatic region 33 between the evaporator region and the condenser region, where pressure drop and temperature change are minimal. Liquid 37 may return to evaporator region 32 through the wick structure 28, along a liquid flow direction 38 by capillary action. The cycle may then repeat.

Circulation of the working fluid in heat pipe 10 may be maintained by the capillary forces that develop in wick structure 28 at the interface between liquid 37 and vapor 35. The difference between the capillary forces at first end 18 and second end 20 of the heat pipe, which may be referred to as capillary pressure drop, pumping pressure, and/or pumping head, may affect the heat transfer capability and performance of heat pipe 10. The liquid and vapor pressure drops due to friction may also affect performance. Geometry of wick structure 28 may affect both pumping pressure and frictional pressure drops, and therefore performance of the heat pipe.

Figure 2:
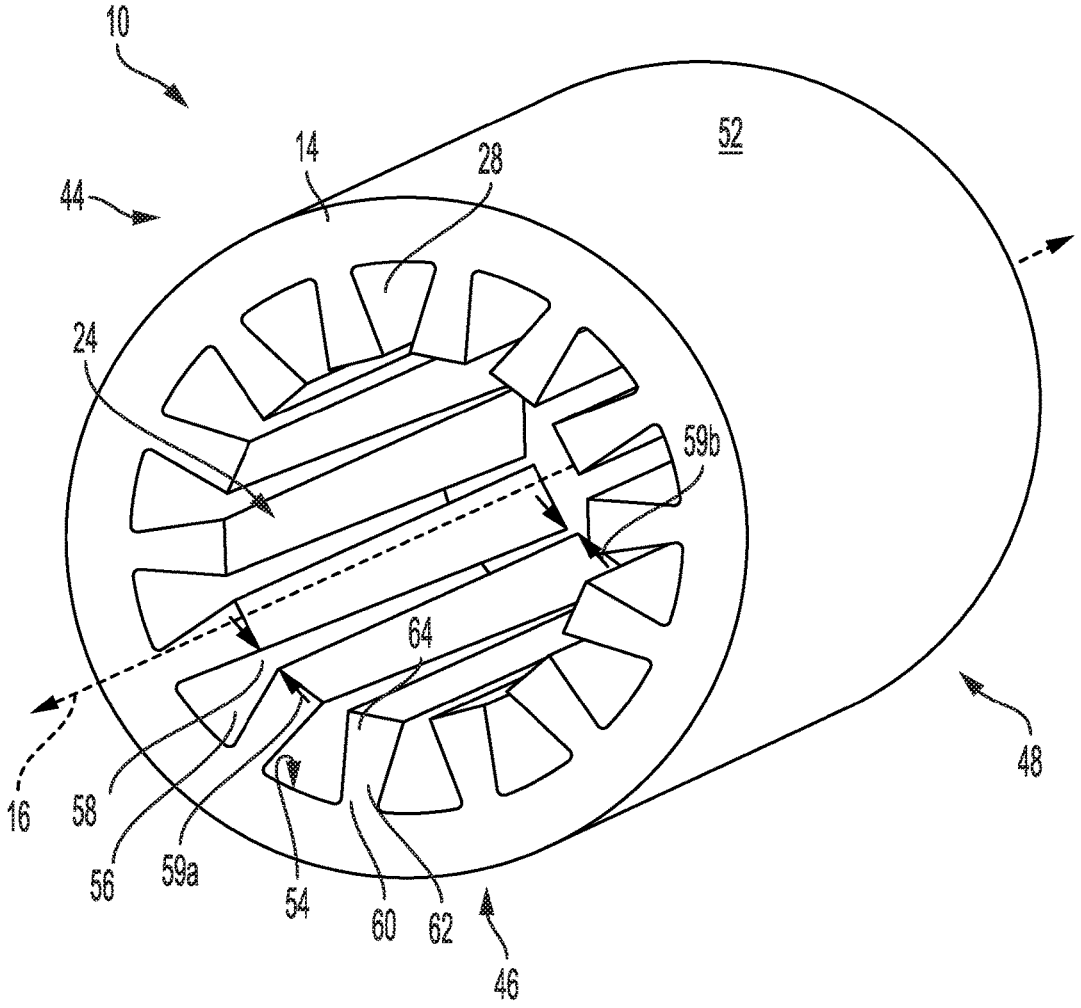
FIG. 2 is an isometric view of a portion of the heat pipe of FIG. 1.

FIG. 2 is an isometric view of a portion 44 of heat pipe 10, between planes 2-2 and 2'-2' of FIG. 1. As shown, portion 44 includes a forward end 46 and a back end 48. Wick structure 28 includes a plurality of grooves 56 between a plurality of groove walls 62. Each groove wall extends radially from inner surface 54 towards central axis 16. Each groove 56 may be described as defined by a channel or enclosing surface extending between the forward and back ends 46, 48 and including surfaces of a pair of adjacent groove walls and a portion of inner surface 54 between the pair of groove walls.

Each groove wall 62 has a head portion 64 and a base portion 66. Head portion 64 is wider than base portion 66, resulting in a trapezoidal shape of the groove walls and of grooves 56. A top surface of head portions 64 of groove walls 62 may be described as defining vapor space 24. Each pair of adjacent head portions 64 defines an opening 58 of one of grooves 56 to vapor space 24. In other words, each groove 56 has an opening 58 to vapor space 24 that is defined between head portions 64 of a pair of adjacent groove walls 62. Groove openings 58 may provide liquid-vapor communication between grooves 56 and vapor space 24 in the evaporator and condenser regions of the heat pipe.

At each point along the heat pipe, each groove opening 58 has a width 59 as measured between the corners or tips of adjacent groove walls. As shown in FIG. 2, a first width 59*a* of groove openings 58 at forward end 46 is different from a second width 59*b* of the groove openings at back end 48. In the present example, each groove opening 58 tapers gradually from forward end 46 to back end 48. Further, each groove opening tapers gradually from the first end 18 of heat pipe 10 to second end 20 of the heat pipe (See FIG. 1). In some examples, width 59 of each groove opening at the second end may be at least 1.5 times the width of the groove opening at the first end. In some examples, width 59 may be three times greater at the second end than at the first end.

Each groove opening 58 tapers from a larger width at the condenser end of the heat pipe to a smaller width at the evaporator end of the heat pipe. Capillary forces that create the pumping pressure of the heat pipe may be formed at the liquid-vapor interface of groove openings 58. The capillary force at any point along the heat pipe may be inversely proportional to the width of the groove openings. More specifically, capillary force may be $$\frac{2\sigma_l \cos\theta}{w}$$

where $\sigma_l$ is surface tension of the liquid, θ is the contact angle, and w is groove width 59. In a grooved heat pipe with constant groove opening width, capillary pressure may be minimum at the condenser end of the heat pipe, and may be maximum at the evaporator end of the heat pipe. Decreasing groove width 59 from the condenser end to the evaporator end of the heat pipe may inversely affect the capillary forces, reinforcing the difference between the two ends and boosting the overall pumping pressure.

In the present example, groove width 59 varies linearly from the first end to the second end of the heat pipe. In some examples, the groove opening may vary in width only between the forward and back ends 46, 48 of portion 44, or may vary in width only for some sections of the heat pipe. In some examples groove openings of adjacent grooves may vary differently from each other. The groove opening of each groove may taper in a direction from the condenser region to the evaporator region, or vice versa. In general, the groove opening of each groove may taper gradually, increase, decrease, vary linearly and/or non-linearly. The variation of the groove openings may depend at least in part on the working fluid contained in the heat pipe and/or the amount of heat transfer required for the thermal control system. Preferably, the groove widths may vary gradually and/or smoothly and taper toward the evaporator region, in order to increase pumping power of the heat pipe.

In the present example, heat pipe 10 is a monolithic piece formed by an additive manufacturing process. That is, pipe wall 14 and wick structure 28, including plurality of groove walls 62, are printed as a single piece. Examples of additive manufacturing processes include, but are not limited to, material extrusion, powder bed fusion, material jetting, binder jetting, directed energy deposition, vat photopolymerization, and sheet lamination.

In the present example, heat pipe 10 comprises a laser-sintered aluminum alloy and is printed using direct metal laser sintering (DMLS). Such a metal alloy may offer good thermal conductance and structural strength. In general, the heat pipe may include any appropriate material and may be manufactured by any effective additive manufacturing method. For example, the heat pipe may be produced from a thermally conductive polymer with fused deposition modeling (FDM) or may be produced from a titanium alloy with electron beam melting (EBM).

Heat pipe 10 may be printed in a series of layers perpendicular to a build axis, as defined by the orientation of the pipe relative to a printer or other additive manufacturing equipment during printing. In the present example, the build axis may be aligned with central axis 16. Additive manufacture may allow a geometry of grooves 56 and/or groove walls 62 not achievable with traditional manufacturing methods. The single piece heat pipe may also improve heat transfer by avoiding typical heat loss at part joints.

Figure 3:
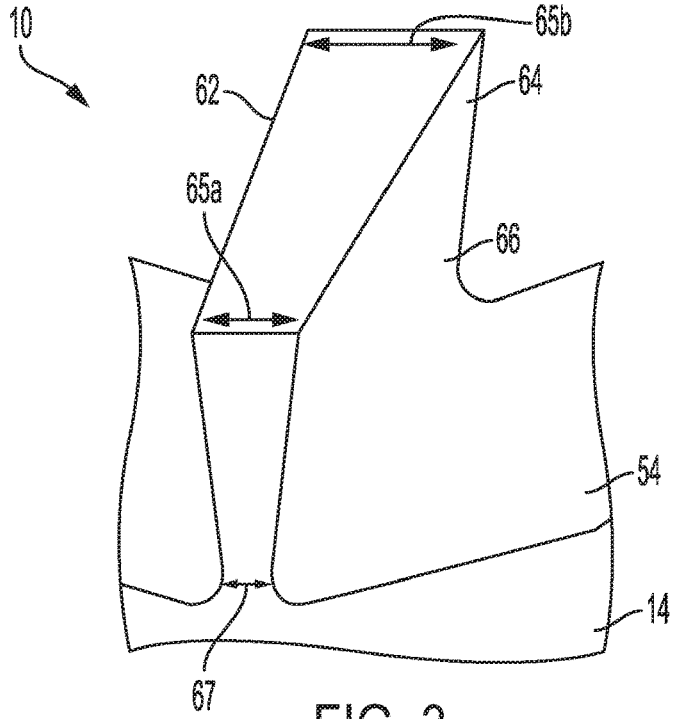
FIG. 3 is an isometric view of an individual groove wall of the portion of FIG. 2.

FIG. 3 is an isometric view of an individual groove wall 62. As shown, groove wall 62 extends from inner surface 54 of pipe wall 14. The groove wall extends radially from the inner surface toward the central axis of the heat pipe. In the present example, groove wall 62 has a symmetrical trapezoidal shape. The groove wall may be described as having a cross-sectional shape at each point along pipe wall 14 that is symmetrical about a radial center line. The groove wall may also be described as symmetrical about a central plane that bisects pipe wall 14.

As described above, groove wall 62 includes a head portion 64 and a base portion 66. Head portion 64 is proximal to the central axis of the heat pipe and base portion 66 is distal from the central axis. Alternatively, base portion 66 may be described as proximal to inner surface 54 of pipe wall 14 and head portion 64 may be described as distal to the inner surface of the pipe wall.

In the present example, head portion 64 has sharp corners and base portion 66 is joined to inner surface 54 by radiused corners. In some examples, the head portion may have rounded corners and/or the base portion may be joined to the inner surface by sharp corners. Corner shapes may be selected according to desired groove geometry and/or to promote effective liquid flow. For example, the depicted radiused corners at base portion 66 may facilitate smooth flow and sharp corners at head portion 64 may encourage a desired meniscus shape.

Head portion 64 of the groove wall has a proximal width 65 and base portion has a distal width 67. The distal width has a constant value. The proximal width is not constant, but varies between forward end 46 and back end 48. In other words, a first proximal width 65*a* at the forward end is different from a second proximal width 65*b* at the back end. The variation of proximal width 65 of groove walls 62 may define the taper of groove openings 58 of grooves 56, as shown in FIG. 2.

As is true for width 59 of groove openings 58, the proximal width of each groove wall may taper gradually, increase, decrease, and/or vary linearly or non-linearly along portion 44 and/or the length of heat pipe 10. The variation of the proximal widths may depend at least in part on the working fluid of the heat pipe and/or the amount of heat transfer required. The proximal width of each groove wall may vary identically, may vary differently, and/or in any manner appropriate to a desired configuration of the grooves and groove openings.

Figure 4:
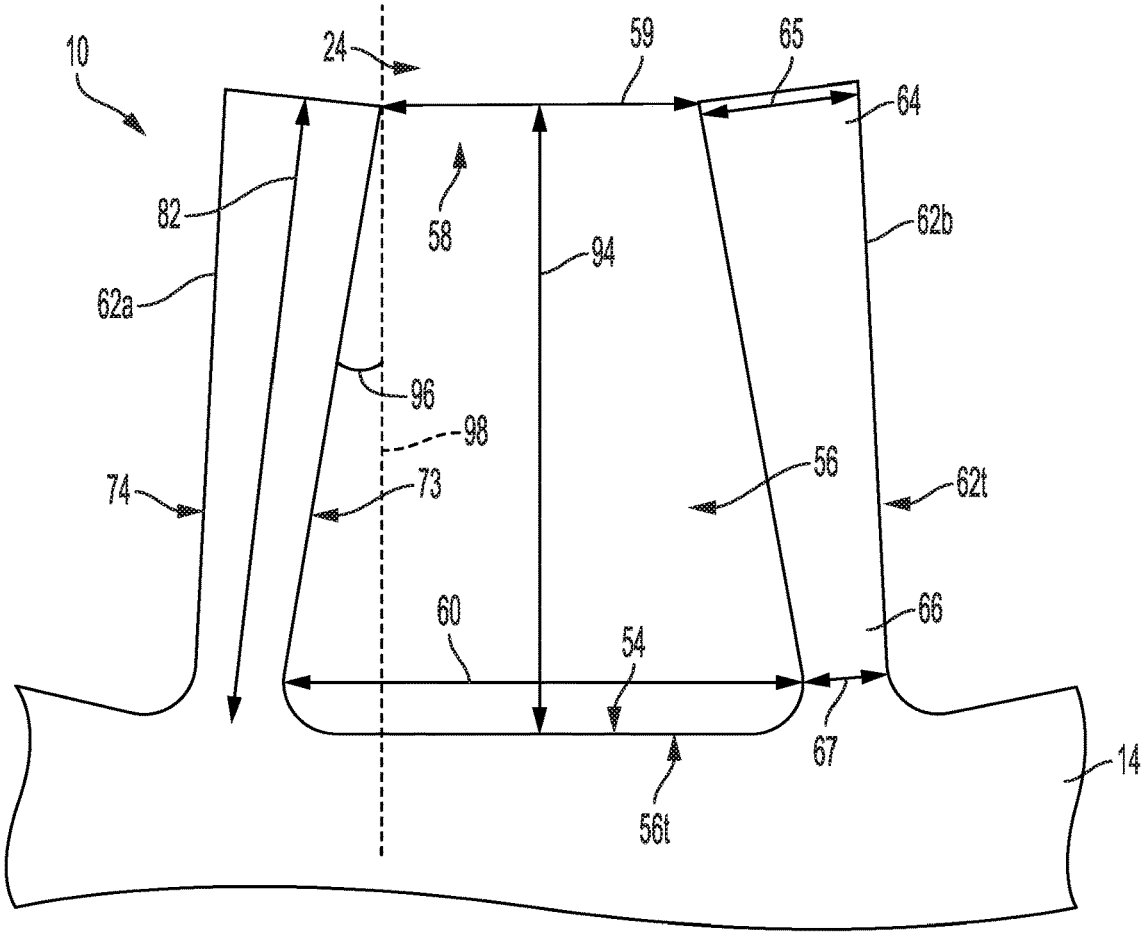
FIG. 4 is a schematic diagram of an individual groove of the portion of FIG. 2.

FIG. 4 is a schematic view of an individual groove 56 formed between adjacent groove walls 62*a*, 62*b* and inner surface 54 of pipe wall 14. In the present example, proximal width 65 is greater than distal width 67 for each of groove walls 62*a*, 62*b*. As a result, groove wall 62 has a first trapezoidal cross-sectional shape 62*t* and groove 56 has a second trapezoidal cross-sectional shape 56*t*, where the first trapezoidal cross-sectional shape is inverted relative to the second trapezoidal cross-sectional shape. As proximal width 65 varies, trapezoidal shapes 56*t*, 62*t* may also vary. In the present example, proximal width 65 varies between approximately 1.5 times distal width 67 to approximately three times the distal width.

Groove 56 has a bottom width 60. At any point along the heat pipe, groove walls 62*a*, 62*b* may be spaced such that bottom width 60 of the groove is approximately six times distal width 67 of groove walls 62*a*, 62*b* and/or such that width 59 of groove openings 58 is approximately two times proximal width 65 of the groove walls.

Groove walls 62*a*, 62*b* each have a first wall surface 73 and a second wall surface 74 on opposing sides. Each surface may be described as extending from a top surface of the groove wall, to inner surface 54. In the present example, each wall surface is planar. At any point along the length of the heat pipe, each surface forms an angle 96 with a line 98 extending radially out from the central axis. As proximal width 65 varies along the heat pipe, angle 96 will also vary.

Groove walls 62*a*, 62*b* each have a height 82, as measured radially from pipe wall 14 to the central axis of the heat pipe. In the present example, height 82 is the same for each groove wall, and is constant along the length of heat pipe 10. Groove 56 similarly has a depth 94, as measured radially from pipe wall 14 to the central axis of the heat pipe. In the present example, depth 94 is the same for each groove, and is constant along the length of the heat pipe.

In some examples, height 82 or depth 94 may vary along the length of the heat pipe. In some examples, the height or depth may vary between walls and grooves, around the circumference of the heat pipe. For example, groove height may alternate, or may vary smoothly to form an oval-shaped vapor space. Preferably, depth 94 and groove bottom width 60 may remain as constant as possible as groove opening width 59 varies.

For heat pipe 10 to function, the pumping pressure $\Delta P_c$ must be greater than the opposing pressure drops resulting from friction and gravity. That is, it must be that $$\Delta P_c - \Delta P_l - \Delta P_v - \Delta P_g \geq 0$$

where $\Delta P_l$ is the liquid pressure drop due to friction, $\Delta P_v$ is the vapor pressure drop due to friction, and $\Delta P_g$ is the pressure drop due to gravity. In addition to boosting pumping pressure, performance of the heat pipe may be improved by reducing one or both of the pressure drops due to friction.

Indeed, trapezoidal groove wicks have shown better performance over those with rectangular groove wicks because the trapezoidal grooves both provide good pumping pressure with a narrow groove opening width, and have a large flow area which reduces liquid pressure drop. For heat pipe 10, a constant groove depth 94 and groove bottom width 60 may maintain a good flow area of groove 56 as groove opening width 59 varies, maintaining the associated reduced liquid pressure drop. A constant groove wall height 82 may maintain a constant cross-sectional area of vapor space 24, avoiding constriction of the vapor space and resulting increase of vapor pressure drop.

The variation between opening groove width 59 and bottom groove width 60 may render traditional constant width trapezoidal groove wicks susceptible to performance loss if the heat pipe is undercharged. This may result from increased effective width at the liquid-vapor interface as the liquid in an undercharged groove does not reach up to groove opening 58. Tapering of groove opening width 59 in heat pipe 10 may reduce or eliminate this susceptibility to reduced performance. Undercharging may manifest increasingly toward the evaporator end of the heat pipe. As the liquid level of the undercharged groove falls toward the evaporator end of the heat pipe, groove opening width 59 may decrease and groove wall angle 96 may increase such that the effective width at the liquid-vapor interface at the liquid level may remain approximately constant.

Illustrative Combinations and Additional Examples

This section describes additional aspects and features of tapered groove width heat pipes, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A heat pipe, comprising:

a tube having an internal surface, a first end, a second end, and a central axis, and a plurality of trapezoidal grooves in the internal surface, defined by a plurality of groove walls, wherein each groove wall has a proximal width closest to the central axis and a distal width furthest from the central axis, the proximal width of a portion of each groove wall tapering gradually between the first end and the second end.

A1. The heat pipe of A0, wherein the proximal width of each groove wall tapers gradually from the first end to the second end.

A2. The heat pipe of A0 or A1, wherein the distal width of each groove wall is constant from the first end to the second end.

A3. The heat pipe of any of A0-A2, wherein each groove wall has a constant height.

A4. The heat pipe of any of A0-A3, further comprising a condenser region at the first end and an evaporator region at the second end, wherein the proximal width of each groove wall decreases from the first end to the second end.

A5. The heat pipe of any of A0-A4, wherein the tube and the plurality of groove walls are monolithic.

A6. The heat pipe of any of A0-A5, wherein the tube and the plurality of groove walls are additively manufactured.

A7. The heat pipe of any of A0-A6, wherein the tube has a vapor space and a wick structure surrounding the vapor space, the vapor space having a constant diameter from the first end to the second end.

A8. The heat pipe of any of A0-A7, wherein the proximal width of a portion of each groove wall varies linearly.

A9. The heat pipe of any of A0-A7, wherein the proximal width of a portion of each groove wall varies non-linearly.

A10. The heat pipe of any of A0-A9, wherein the proximal width of each groove wall has a taper profile that depends at least partially on a composition of matter contained in the heat pipe.

A11. The heat pipe of any of A0-A10, wherein the proximal width of each groove wall is greater than the distal width of the groove wall.

B0. A heat pipe, comprising:

a pipe having a vapor space, a first end and a second end, and a wick structure surrounding the vapor space and having a plurality of grooves, wherein each groove has an opening to the vapor space, a portion of each opening varying gradually in width between the first end and the second end.

B1. The heat pipe of B0, wherein the opening of each groove varies gradually in width from the first end to the second end.

B2. The heat pipe of B0 or B1, wherein each groove has a distal width that remains constant from the first end to the second end.

B3. The heat pipe of any of B0-B2, wherein the vapor space has a constant cross-sectional area.

B4. The heat pipe of any of B0-B3, wherein the width of the opening of each groove at the first end is at least 1.5 times the width of the opening of the groove at the second end.

C0. A heat pipe, comprising:

a pipe having a vapor space, a first end, and a second end, and a wick structure surrounding the vapor space and having a plurality of grooves, wherein the plurality of grooves are defined between a plurality of walls, each wall having a first width proximate the vapor space and a second width distal from the vapor space, the first width of a portion of each wall tapering gradually between the first end and the second end of the pipe.

C1. The heat pipe of C0, wherein the first width of each wall tapers gradually from the first end to the second end of the pipe.

C2. The heat pipe of any of C0-C1, wherein the second width of each wall is constant from the first end to the second end of the pipe.

C3. The heat pipe of any of C0-C2, further comprising a condenser region at the first end of the pipe, and an evaporator region at the second end, wherein the first width of each wall increases from the first end to the second end of the pipe.

Advantages, Features, and Benefits

The different examples of the heat pipe described herein provide several advantages over known solutions for heat pipe design. For example, illustrative examples described herein allow improved heat capability and transfer of greater heat loads.

Additionally, and among other benefits, illustrative examples described herein improve capillary pumping pressure.

Additionally, and among other benefits, illustrative examples described herein avoid performance loss due to undercharging.

Additionally, and among other benefits, illustrative examples described herein retain the advantages associated with a large flow area.

No known system or device can perform these functions, particularly in a quickly and inexpensively manufacturable design. Thus, the illustrative examples described herein are particularly useful for an additively manufactured heat pipe. However, not all examples described herein provide the same advantages or the same degree of advantage.

CONCLUSION

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A heat pipe, comprising:

a tube having an internal surface, a first end, a second end, and a central axis, and a plurality of trapezoidal grooves in the internal surface, defined by a plurality of groove walls, wherein each groove wall has a trapezoidal cross-sectional shape, a proximal width closest to the central axis and a distal width furthest from the central axis, the proximal width of each groove wall tapering between the first end and the second end, the proximal width of the groove wall being greater than the distal width, the distal width of each groove wall of the plurality of groove walls remaining constant from the first end to the second end, and each groove wall forming an angle with a line extending radially out from the central axis, and the angle varying between the first end and the second end.

2. The heat pipe of claim 1, wherein the proximal width of each groove wall tapers from the first end to the second end.

3. The heat pipe of claim 1, wherein each groove wall has a constant height.

4. The heat pipe of claim 1, further comprising a condenser region at the first end and an evaporator region at the second end, wherein the proximal width of each groove wall decreases from the first end to the second end.

5. The heat pipe of claim 1, wherein the tube and the plurality of groove walls are monolithic, and are additively manufactured.

6. The heat pipe of claim 1, wherein the tube has a vapor space and a wick structure surrounding the vapor space, the vapor space having a constant diameter from the first end to the second end.

7. The heat pipe of claim 1, wherein the proximal width of each groove wall varies linearly.

8. The heat pipe of claim 1, wherein the proximal width of each groove wall has a taper profile that depends at least partially on a working fluid contained in the heat pipe.

9. The heat pipe of claim 1, further comprising a condenser region at the first end and an evaporator region at the second end, wherein the angle of each groove wall increases from the condenser region to the evaporator region.

10. A heat pipe, comprising:

a pipe structure having a vapor space, a first end and a second end, and a wick structure surrounding the vapor space and having a plurality of grooves, wherein:

each groove has an opening to the vapor space and a groove bottom distal from the vapor space, each groove having a wall forming an angle with the groove bottom, the angle varies between the first end and the second end of the pipe, and each wall has a trapezoidal cross-sectional shape, a first width proximate the opening to the vapor space and a second width proximate the groove bottom, the first width of each wall tapering between the first end and the second end of the pipe, the first width of the wall being greater than the second width, the second width of each wall of the plurality of walls remaining constant from the first end to the second end of the pipe.

11. The heat pipe of claim 10, wherein the opening of each groove varies in width from the first end to the second end.

12. The heat pipe of claim 10, wherein the vapor space has a constant cross-sectional area.

13. The heat pipe of claim 10, wherein the width of the opening of each groove at the first end is at least 1.5 times the width of the opening of the groove at the second end.

14. A heat pipe, comprising:

a pipe having a vapor space, a first end, and a second end, and a central axis, and a wick structure surrounding the vapor space and having a plurality of grooves, wherein the plurality of grooves are defined between a plurality of walls, each wall having a trapezoidal cross-sectional shape, a first width proximate the vapor space and a second width distal from the vapor space, the first width of each wall tapering between the first end and the second end of the pipe, the first width of the wall being greater than the second width, the second width of each wall of the plurality of walls remaining constant from the first end to the second end, each wall forming an angle with a line extending radially out from the central axis, and the angle varying with the first width.

15. The heat pipe of claim 14, wherein the first width of each wall tapers from the first end to the second end of the pipe.

16. The heat pipe of claim 14, further comprising a condenser region at the first end of the pipe, and an evaporator region at the second end, wherein the first width of each wall increases from the first end to the second end of the pipe.

17. The heat pipe of claim 14, wherein the wall is symmetrical about a central plane, the central plane being coincident with the central axis and bisecting the wall.

18. The heat pipe of claim 14, wherein the pipe and the plurality of walls are monolithic.

19. The heat pipe of claim 14, wherein the wall at an evaporator region of the heat pipe has a first angle, the wall at a condenser region of the heat pipe has a second angle, the first angle being greater than the second angle.

20. The heat pipe of claim 19, wherein an effective width at a liquid-vapor interface of a working fluid circulating in the heat pipe remains a constant.

* * * * *